US007976650B2

(12) United States Patent
Drillet et al.

(10) Patent No.: US 7,976,650 B2
(45) Date of Patent: Jul. 12, 2011

(54) METHOD FOR PRODUCTION OF SHEET OF AUSTENITIC IRON/CARBON/MANGANESE STEEL AND SHEETS PRODUCED THUS

(75) Inventors: Pascal Drillet, Rozerieulles (FR); Daniel Bouleau, Metz (FR)

(73) Assignee: ARCELOR France, Saint Denis (FR)

( * ) Notice: Subject to any disclaimer, the term of this patent is extended or adjusted under 35 U.S.C. 154(b) by 945 days.

(21) Appl. No.: 11/577,539

(22) PCT Filed: Oct. 10, 2005

(86) PCT No.: PCT/FR2005/002492

§ 371 (c)(1),
(2), (4) Date: Oct. 9, 2007

(87) PCT Pub. No.: WO2006/042931

PCT Pub. Date: Apr. 27, 2006

(65) Prior Publication Data

US 2008/0053580 A1 Mar. 6, 2008

(30) Foreign Application Priority Data

Oct. 20, 2004 (FR) ..... 04 11189

(51) Int. Cl.
*C22C 38/04* (2006.01)
*C21D 8/02* (2006.01)
*C21D 9/46* (2006.01)

(52) U.S. Cl. ..... 148/620; 148/329; 148/621; 148/628; 148/655

(58) Field of Classification Search ..... 148/620
See application file for complete search history.

(56) References Cited

U.S. PATENT DOCUMENTS

| | | | | |
|---|---|---|---|---|
| 2,435,946 | A * | 2/1948 | Robiette et al. | 148/613 |
| 2,448,753 | A * | 9/1948 | Weesner et al. | 148/620 |
| 5,810,950 | A | 9/1998 | Kim et al. | |
| 7,556,865 | B2 * | 7/2009 | Drillet et al. | 428/659 |
| 2003/0047257 | A1 | 3/2003 | Kami et al. | |

FOREIGN PATENT DOCUMENTS

| | | |
|---|---|---|
| EP | 1 067 203 | 1/2001 |
| JP | 6 100941 | 4/1994 |
| JP | 11 199991 | 7/1999 |
| JP | 2000336466 A * | 12/2000 |
| WO | 93 13233 | 7/1993 |

* cited by examiner

*Primary Examiner* — Roy King
*Assistant Examiner* — Christopher Kessler
(74) *Attorney, Agent, or Firm* — Oblon, Spivak, McClelland, Maier & Neustadt, L.L.P.

(57) ABSTRACT

The invention relates to a process for manufacturing a corrosion-resistant cold-rolled sheet of iron-carbon-manganese austenitic steel, comprising the following steps: a sheet whose chemical composition comprises, the contents being expressed by weight: 0.35%≦C≦1.05%, 16%≦Mn≦24%, the balance of the composition consisting of iron and inevitable impurities resulting from its smelting, is provided; said sheet is cold-rolled; and a recrystallization annealing treatment is carried out on said sheet in a furnace containing a gas chosen from gases that are reducing with respect to iron, the parameters of said annealing being chosen in such a way that said sheet is covered on both its sides with an essentially amorphous (Fe,Mn)O oxide sublayer and with an external crystalline manganese oxide (MnO) layer, the total thickness of these two layers being equal to or greater than 0.5 microns.

25 Claims, No Drawings

METHOD FOR PRODUCTION OF SHEET OF AUSTENITIC IRON/CARBON/MANGANESE STEEL AND SHEETS PRODUCED THUS

The invention relates to the economic manufacture of cold-rolled sheet of iron-carbon-manganese austenitic steel having very high mechanical properties and very good corrosion resistance.

Certain applications, especially in the automotive field, require the use of structural materials that combine high tensile strength with great deformability. In the case of cold-rolled sheet ranging from 0.2 mm to 6 mm in thickness, the applications relate for example to parts that contribute to the safety and durability of motor vehicles or else to skin parts. To meet the simultaneous requirements of strength and ductility, steels having a completely austenitic structure, such a Fe—C (up to 1.5% )-Mn(15 to 35%) steels (the contents being expressed by weight) optionally containing other elements, such as silicon nickel or chromium, are known.

Such steel sheet in the form of cold-rolled and annealed coils may be delivered either with an anticorrosion coating, for example based on zinc, or delivered "bare" to the automobile industry. The latter situation is then encountered for example in the manufacture of automobile parts that are less exposed to corrosion, in which a treatment of the phosphatization and cataphoresis type is simply carried out without there being a need for a zinc coating. The steel sheet may also be delivered bare if a customer itself carries out or has carried out a coating treatment such as a hot-dip galvanizing treatment or an electrogalvanizing treatment.

Thus, when the Fe—C—Mn austenitic steel sheet has to be delivered bare to the customer, a temporary protection layer is applied, for example a film of oil, so as to prevent surface oxidation between the moment when the product is cold-rolled and annealed and when it is actually used to manufacture parts. This is because, during storage or transportation of the coils temperature and atmosphere cycles propitious to the development of a surface oxidation deleterious to use may alternate. In addition, the temporary protective oil film may be locally modified by friction or contact when being handled, and the corrosion resistance may thus be reduced. It is therefore very desirable to have a manufacturing process that avoids the risk of blanks or parts oxidizing, before or after drawing, before or after ironing and before painting operations.

Moreover, as already mentioned earlier, in the case of applications in which the service conditions are less severe in terms of corrosion, it would be desirable to have a process for manufacturing steel having high mechanical properties that gives satisfactory corrosion resistance either in the as-annealed state or after subsequent treatments of the phosphatizing and cataphoretic painting type.

The object of the invention is therefore to have an economically manufactured cold-rolled sheet of iron-carbon-manganese austenitic steel having a high strength, and advantageous strength-elongation combination and very good oxidation resistance in the absence of a metal coating, such as a zinc-based coating.

Without achieving the corrosion resistance conferred by a zinc-based coating the subject of the invention is protection that very significantly improves the processing conditions for bare sheet.

For this purpose, the subject of the invention is a process for manufacturing a corrosion-resistant cold-rolled sheet of iron-carbon-manganese austenitic steel, comprising the following steps:

a sheet whose chemical composition comprises, the contents being expressed by weight 0.35%≦C≦1.05%, 16%≦Mn≦24%, the balance of the composition consisting of iron and inevitable impurities resulting from its smelting, is provided; the sheet is cold-rolled; and a recrystallization annealing treatment is carried out on said sheet in a furnace having an atmosphere that is reducing with respect to iron and oxidizing with respect to manganese, the parameters of said annealing being chosen in such a way that said sheet is covered on both its sides with an essentially amorphous (Fe,Mn)O oxide sublayer and with an external crystalline manganese oxide (MnO) layer, the total thickness of these two layers being equal to or greater than 0.5 microns.

Advantageously, the composition of the sheet comprises: Si≦3%, Al≦0.050%, S≦0.030%, P≦0.080%, N≦0.1%, and, optionally, one or more elements such as Cr≦1%, Mo≦0.40%, Ni≦1%, Cu≦5%, Ti≦0.50% Nb≦0.50%, V≦0.50%.

Preferably, the chemical composition of the sheet has a carbon content by weight such that: 0.5≦C≦0.7%.

Advantageously the chemical composition of the sheet has a carbon content by weight such that: 0.85≦C≦1.05%.

According to a preferred embodiment, the chemical composition of the sheet has a manganese content by weight such that: 20≦Mn≦24%.

Advantageously, the chemical composition of the sheet has a manganese content by weight such that: 16≦Mn≦19%.

Preferably, the total thickness of the two oxide surface layers formed during the annealing has a thickness equal to or greater than 1.5 microns.

According to a preferred feature, a recrystallization annealing treatment is carried out on the sheet in a furnace having an atmosphere that is reducing with respect to iron and with respect to manganese, in which the oxygen partial pressure is equal to or greater than $2\times10^{-17}$ Pa.

Advantageously, the annealing treatment is carried out in a furnace having an atmosphere that is reducing with respect to iron and oxidizing with respect to manganese, in which the oxygen partial pressure is greater than $5\times10^{-16}$ Pa.

Also preferably, the essentially amorphous (Fe,Mn)O oxide sublayer formed during annealing has a continuous character.

According to a preferred embodiment, the crystalline MnO oxide layer has a continuous character.

Also preferably, the recrystallization annealing is carried out within a compact continuous annealing installation.

According to a preferred embodiment, a subsequent phosphatizing treatment is carried out on said sheet.

Also preferably, a subsequent cataphoresis treatment is carried out on said sheet.

The subject of the invention is also a corrosion-resistant cold-rolled and annealed sheet of iron-carbon-manganese austenitic steel, the chemical composition of which comprises, the contents being expressed by weight: 0.35%≦C≦1.05%, 16%≦Mn≦24%, the balance of the composition consisting of iron and inevitable impurities resulting from its smelting, the sheet being coated on both its sides with an essentially amorphous (Fe,Mn)O oxide sublayer and with an external crystalline manganese oxide (MnO) layer, the total thickness of these two layers being equal to or greater than 0.5 microns.

Advantageously, the chemical composition comprises the following elements: S≦3%, Al≦0.050%, S≦0.030%, P≦0.080% N≦0.1% and, optionally, one or more elements such as: Cr≦1%, Mo≦0.40%, Ni≦1%, Cu≦5%, Ti≦0.50%, Nb≦0.50%, V≦0.50%.

Preferably, the chemical composition of the sheet has a carbon content by weight such that: $0.5 \leqq C \leqq 0.7\%$.

Advantageously, the chemical composition of the sheet has a carbon content by weight such that: $0.85 \leqq C \leqq 1.05\%$.

According to a preferred embodiment, the chemical composition of the sheet has a manganese content by weight such that: $20 \leqq Mn \leqq 24\%$.

Advantageously, the chemical composition of the sheet has a manganese content by weight such that: $16 \leqq Mn \leqq 19\%$.

According to a preferred feature of the invention, the total thickness of the two layers is equal to or greater than 1.5 microns.

According to a preferred feature, the essentially amorphous (Fe,Mn)O oxide sublayer has a continuous character.

Preferably, the external crystalline MnO oxide layer has a continuous character.

Preferably, the sheet includes a phosphatized layer superposed on the external crystalline MnO oxide layer.

Also preferably, the sheet includes a cataphoretic layer superposed on the phosphatized layer.

The subject of the invention is also the use of a sheet manufactured by means of an above process for the manufacture of automobile structural components or skin parts.

The subject of the invention is also the use of a sheet described above for the manufacture of structural components or skin parts in the automotive field.

Other features and advantages of the invention will become apparent over the course of the description below, given by way of example.

After many trials, the inventors have shown that the various requirements mentioned above are met by observing the following conditions:

As regards the chemical composition of the steel, carbon plays a very important role on the formation of the microstructure—it increases the stacking fault energy and promotes stability of the austenitic phase. In combination with a manganese content ranging from 16 to 24% by weight, this stability is obtained for a carbon content of 0.35% or higher. In particular, when the carbon content is between 0.5% and 0.7%, the stability of the austenite is greater and the strength increased. In addition, when the carbon content is greater than 0.85%, an even greater mechanical strength is obtained. However, when the carbon content is greater than 1.05%, it becomes difficult to prevent carbide precipitation, which occurs during certain thermal cycles in industrial manufacture, in particular during cooling after coiling, and which degrades both ductility and toughness.

Manganese is also an essential element for increasing the strength, increasing the stacking fault energy and stabilizing the austenitic phase. Manganese also plays a very important role as regards the formation of particular oxides during the continuous annealing step, these oxides playing a protective role with respect to subsequent corrosion and coatability. If its manganese content is less than 16%, there is a risk of martensitic phases forming, which appreciably decrease the deformability. A manganese content increased up to 19% allows the manufacture of steel having a greater stacking fault energy, thereby promoting a twinning deformation mode. When the manganese content is between 20 and 24%, in relation to the carbon content, a deformability suitable for the manufacture of parts having high mechanical properties is obtained.

However, when the manganese content is greater than 24%, the ductility at ambient temperature is degraded. In addition, for cost reasons, it is not desirable for the manganese content to be high.

Aluminum is a particularly effective element for deoxidizing the steel. Like carbon, it increases the stacking fault energy. However, its presence in an excessive amount in steels having a high manganese content has drawbacks. This is because manganese increases the solubility of nitrogen in liquid iron and if too large an amount of aluminum is present in the steel, nitrogen, which combines with aluminum, precipitates in the form of aluminum nitrides, impeding the migration of grain boundaries during hot transformation and very appreciably increases the risk of cracks appearing. An Al content not exceeding 0.050% makes it possible to avoid AlN precipitation. Correspondingly, the nitrogen content must not exceed 0.1% so as to avoid this precipitation and the formation of volume defects (blowholes) during solidification.

Silicon is also an effective element for deoxidizing the steel and for solid-phase hardening. However, above a content of 3%, it tends to form undesirable oxides and must therefore be kept below this limit.

Sulfur and phosphorus are impurities that embrittle the grain boundaries. Their respective contents must not exceed 0.030 and 0.080%, respectively, so as to maintain sufficient hot ductility.

Chromium and nickel may optionally be used to increase the strength of the steel by solid-solution hardening. However, since chromium reduces the stacking fault energy, its content must not exceed 1%. Nickel contributes to obtaining a high elongation at break and in particular increases the toughness. However, it is also desirable, for cost reasons, to limit the nickel content to a maximum value not exceeding 1%. For similar reasons, molybdenum may be added in an amount not exceeding 0.40%.

Likewise, optionally, an addition of copper up to a content not exceeding 5% is one means of hardening the steel by precipitation of metallic copper. However, above this content, copper is responsible for the appearance of surface defects in hot-rolled sheet.

Titanium, niobium and vanadium are also elements that may be optionally used for hardening by the precipitation of carbonitrides. However, when the Nb or V or Ti content is greater than 0.50%, excessive precipitation of carbonitrides may cause a reduction in toughness, which must be avoided.

The manufacturing process according to the invention is carried out as follows:

A steel with the composition given above is smelted. The steel sheet is then hot-rolled so as to obtain a product having a thickness ranging from about 0.6 to 10 mm. This steel sheet is then cold-rolled down to a thickness of about 0.2 to 6 mm. After cold rolling, the anisotropic microstructure of the steel is composed of highly deformed grains, and the ductility is reduced. According to the invention, apart from obtaining satisfactory mechanical properties, the aim of the recrystallization annealing that follows is to impart particularly high corrosion resistance.

Usually, the steel sheet undergoes recrystallization annealing in order to give it a particular microstructure and particular mechanical properties. Under industrial conditions, this recrystallization annealing is carried out in a furnace in which an atmosphere that is reducing with respect to iron prevails. For this purpose, the sheet runs through a furnace consisting of a chamber isolated from the external atmosphere, in which a reducing gas flows. For example, this gas may be chosen from hydrogen and nitrogen/hydrogen mixtures and may have a dew point between −40° C. and −15° C.

The inventors have demonstrated that increased corrosion resistance is obtained when the annealing conditions are chosen precisely for obtaining, on both sides of the sheet, a surface oxide layer having a total thickness equal to or greater than 0.5 microns. This surface oxide layer is itself formed by:

- a continuous or discontinuous mixed oxide (Fe,Mn)O sublayer in contact with the substrate, said sublayer having an essentially amorphous character. The latter term denotes the fact that the sublayer consists of more than 95% of a mixed oxide of amorphous character; and
- a continuous or discontinuous manganese oxide MnO layer having a crystalline character.

It has been demonstrated that the corrosion resistance is particularly high when the essentially amorphous (Fe,Mn)O surface oxide layer is continuous. This feature increases the corrosion resistance, the grain boundaries proving to be zones of lower resistance.

The inventors have also demonstrated that particular conditions for continuously annealing iron-carbon-manganese austenitic steel sheet, in the presence of an atmosphere that is reducing with respect to iron and oxidizing with respect to manganese, result in the formation of such a surface layer.

In particular, one of the methods of manufacture according to the invention consists in annealing in a furnace when the oxygen partial pressure is $2\times10^{-17}$ Pa (about $2\times10^{-22}$ bar) or higher. For example, the gas may be chosen from hydrogen or mixtures comprising between 20 and 97% nitrogen by volume, the balance being hydrogen. Thanks to his general knowledge, for a given atmosphere, a person skilled in the art will therefore adapt the operating parameters of the annealing furnace (such as the annealing temperature, or the dew point) for the purpose of obtaining an oxygen partial pressure greater than $2\times10^{-17}$ Pa.

As will be explained later, a layer having a thickness equal to or greater than 1.5 microns may be desirable for the purpose of obtaining an even more advantageous corrosion resistance. One of the manufacturing methods according to the invention consists in annealing in a furnace with an oxygen partial pressure of $5\times10^{-16}$ Pa (about $5\times10^{-21}$ bar) or higher.

Rapid annealing in an atmosphere within a compact continuous annealing installation, including for example rapid heating by means of induction heating and/or rapid cooling, may be advantageously used for implementing the invention.

To give an example, the following embodiments will show other advantages afforded by the invention:

An austenitic Fe—C—Mn steel, the composition of which expressed in percentages by weight is given in Table 1, was produced in the form of hot-rolled sheet, which was then cold-rolled down to a thickness of 1.5 mm.

| C | Mn | Si | S | P | Al | Cu | Cr | Ni | Mo | N |
|---|---|---|---|---|---|---|---|---|---|---|
| 0.61 | 21.5 | 0.49 | 0.001 | 0.016 | 0.003 | 0.02 | 0.053 | 0.044 | 0.009 | 0.01 |

The steel sheet was then subjected to recrystallization annealing treatments for 60 s in a nitrogen atmosphere containing 15% hydrogen by volume, under the following conditions:

annealing corresponding to conventional conditions: temperature: 810° C., dew point: −30° C.; oxygen partial pressure below $1.01\times10^{-18}$Pa; and annealing according to the invention: temperature: 810° C.; dew point: +10° C. oxygen partial pressure greater than $5.07\times10^{-16}$ Pa.

These annealing conditions correspond to a strength of 1000 MPa and an elongation at break of greater than 60%.

Under the conventional conditions, the total thickness of the oxide surface layer is 0.1 microns. In the case of annealing at 810° C. carried out with a dew point significantly higher than the usual conditions, the surface oxide layer formed (essentially amorphous (Fe, Mn)O sublayer and crystalline MnO layer) has a total thickness of 1.5 microns. The (Fe, Mn)O layer having an essentially amorphous character is perfectly continuous.

The annealed sheet was then oiled, using a Ferrocoat® N6130 temporary protection oil in an amount of 0.5 g/m$^2$. This operation was to reproduce the temporary protection of the coils during the period that elapses between the production in a steel plant of a cold-rolled bare steel coil and its subsequent use. A hot/wet corrosion test was carried out on specimens measuring 200 mm×100 mm. This test, in which hot/wet phases (eight hours at 40° C. with 100% relative humidity) alternate with room-temperature phases (16 h), has the purpose of determining the corrosion resistance during a climate change.

Next, the conditions under which red rust appeared, red rust being characteristic of corrosion of the steel substrate, or the conditions under which this red rust spread over an area equivalent to 10% of the test specimen were noted.

The results, expressed as the number of cycles for the appearance of red rust or for 10% coverage, are the following:

| Total thickness of the oxide layer (Fe,Mn)O and MnO | Number of cycles for red rust to appear | Number of cycles resulting in 10% coverage with rust |
|---|---|---|
| 0.1 micron | 6 | 11 |
| 1.5 microns (*) | >18 | >20 |

(*): According to the invention.

Thus, the annealed sheet according to the invention has a very high corrosion resistance, the time before red rust appears being practically twice as long.

It is common practice in the automobile industry to specify a minimum corrosion resistance, expressed in terms of number of cycles in the hot/wet corrosion test before 10% coverage of the specimen. A minimum strength of 15 cycles is often required.

The inventors have demonstrated that the minimum resistance of 15 cycles was obtained when the total thickness of the oxide layer ((Fe,Mn)O and MnO) was equal to or greater than 1 micron.

Moreover, perforation corrosion resistance tests were carried out for the abovementioned annealing conditions. The results, expressed as the percentage of red rust after 2 or 5 cycles (one cycle consisting of 35° C./4 h exposure to salt fog followed by a 60° C./2 h drying phase and a 50° C./2 h exposure to a 95% relative humidity) are given in the table below:

| Total thickness of the oxide layer (Fe,Mn)O and MnO | Proportion of red rust after 2 cycles | Proportion of red rust after 5 cycles |
|---|---|---|
| 0.1 micron | 100% | 100% |
| 1.5 microns (*) | 30% | 80% |

(*): According to the invention.

These results demonstrate the improvement in perforation corrosion resistance afforded by the invention. In particular, the development of oxidation is very substantially retarded when the thickness of the oxide layer is equal to or greater than 1.5 microns.

The cold-rolled and annealed sheet according to the invention may advantageously be subjected to a phosphatizing treatment. Specifically, the inventors have demonstrated that the crystalline character of the external MnO layer and its nature lend themselves well to coating by phosphatizing. This character is all the more pronounced when the external crystallized layer forms a continuous film, leading to very uniform protection by phosphatizing.

After phosphatizing, subsequent coating with paint by cataphoresis makes it possible to manufacture satisfactorily corrosion-resistant component. The parts thus obtained will be advantageously used in applications in which the corrosion resistance requirements are less stringent.

The process according to the invention will be particularly advantageously implemented for manufacturing bare cold-rolled Fe—C—Mn austenitic steel sheet when the sheet storage and transportation conditions require particular attention with respect to the risk of oxidation.

The invention claimed is:

1. A process for manufacturing a corrosion-resistant cold-rolled sheet of iron-carbon-manganese austenitic steel, the process comprising:

providing a sheet which chemical composition comprises:

0.35 wt. %≦C≦1.05 wt. %, 16 wt. %≦Mn≦24 wt. %, with the balance of the composition being iron and inevitable impurities resulting from smelting of the steel;

cold-rolling said sheet; and carrying out a recrystallization annealing treatment on said sheet in a furnace having an atmosphere that is reducing with respect to iron and oxidizing with respect to manganese, wherein parameters of said annealing are chosen so that said sheet is covered on both faces with an essentially amorphous (Fe,Mn)O oxide sublayer and with an external crystalline manganese oxide MnO layer, and the total thickness of the amorphous oxide and manganese oxide layers is equal to or greater than 0.5 microns.

2. The process according to claim 1, wherein the chemical composition of said sheet further comprises:

Si≦3 wt. %,

Al≦0.050 wt. %,

S≦0.030 wt. %,

P≦0.080 wt. %,

N≦0.1 wt. %, and, optionally, one or more following elements:

Cr≦1 wt. %,

Mo≦0.40 wt. %,

Ni≦1 wt. %,

Cu≦5 wt. %,

Ti≦0.50 wt. %,

Nb≦0.50 wt. %, and

V≦0.50 wt. %.

3. The process according to claim 1 or 2, wherein said sheet has a carbon content of 0.5-0.7 wt. %.

4. The process according to claim 1 or 2, wherein said sheet has a carbon content of 0.85-1.05 wt. %.

5. The process according to claim 1, wherein said sheet has a manganese content of 20-24 wt. %.

6. The process according to claim 1, wherein said sheet has a manganese content of 16-19 wt. %.

7. The process according to claim 1, wherein parameters of said annealing are chosen so that the total thickness of said amorphous oxide and manganese oxide layers is equal to or greater than 1.5 microns.

8. The process according to claim 7, wherein said recrystallization annealing treatment is carried out on said sheet in a furnace having an atmosphere that is reducing with respect to iron and oxidizing with respect to manganese, and the oxygen partial pressure is equal to or greater than $5\times10^{-16}$ Pa.

9. The process according to claim 1, wherein the recrystallization annealing treatment is carried out on said sheet in a furnace having an atmosphere that is reducing with respect to iron and oxidizing with respect to manganese, and the oxygen partial pressure is equal to or greater than $2\times10^{-17}$ Pa.

10. The process according to claim 1, wherein said essentially amorphous (Fe,Mn)O oxide sublayer is continuous.

11. The process according to claim 1, wherein said crystalline MnO oxide layer is continuous.

12. The process according to claim 1, wherein said recrystallization annealing is carried out within a compact continuous annealing installation.

13. The process according to claim 1, wherein a phosphatizing treatment is carried out after said recrystallization annealing of the sheet.

14. The process according to claim 13, wherein a subsequent cataphoresis treatment of the sheet is carried out.

15. A corrosion-resistant cold-rolled and annealed sheet of an iron-carbon-manganese austenitic steel, wherein the chemical composition of the sheet comprises:

0.35 wt. %≦C≦1.05 wt. %,

16% wt. %≦Mn≦24 wt. %, the balance of the composition being iron and inevitable impurities, wherein the sheet is coated on both faces with an essentially amorphous (Fe,Mn)O oxide sublayer and with an external crystalline manganese oxide MnO layer, and the total thickness of the amorphous oxide and manganese oxide layers is equal to or greater than 0.5 microns.

16. The corrosion-resistant cold-rolled and annealed sheet of iron-carbon-manganese austenitic steel according to claim 15, wherein the sheet further comprises:

Si≦3 wt. %,

Al≦0.050 wt. %,

S≦0.030 wt. %,

P≦0.080 wt. %,

N≦0.1 wt. %, and, optionally, one or more following elements:

Cr≦1 wt. %,

Mo≦0.40 wt. %,

Ni≦1 wt. %,

Cu≦5 wt. %,

Ti≦0.50 wt. %,

Nb≦0.50 wt. %, and

V≦0.50 wt. %.

17. The corrosion-resistant cold-rolled and annealed sheet of iron-carbon-manganese austenitic steel according to claim 15 or 16, wherein the sheet has a carbon content of 0.5-0.7 wt. %.

18. The corrosion-resistant cold-rolled and annealed sheet of iron-carbon-manganese austenitic steel according to claim 15 or 16, wherein the sheet has a carbon content of 0.85-1.05 wt. %.

19. The corrosion-resistant cold-rolled and annealed sheet of iron-carbon-manganese austenitic steel according to claim 15, wherein the sheet has a manganese content of 20-24wt. %.

20. The corrosion-resistant cold-rolled and annealed sheet of iron-carbon-manganese austenitic steel according to claim 15, wherein the sheet has a manganese content of 16-19 wt. %.

21. The cold-rolled and annealed sheet according to claim 15, wherein the total thickness of the amorphous and manganese layers is equal to or greater than 1.5 microns.

22. The cold-rolled and annealed sheet according to claim 15, wherein the essentially amorphous (Fe,Mn)O oxide sublayer is continuous.

23. The cold-rolled and annealed sheet according to claim 15, wherein the external crystalline MnO oxide layer is continuous.

24. The cold-rolled and annealed sheet according to claim 15, wherein a phosphatized layer is superposed on the external crystalline MnO oxide layer.

25. The cold-rolled and annealed sheet according to claim 24, wherein a cataphoretic layer is subsequently superposed on the phosphatized layer.

* * * * *

UNITED STATES PATENT AND TRADEMARK OFFICE

CERTIFICATE OF CORRECTION

PATENT NO. : 7,976,650 B2
APPLICATION NO. : 11/577539
DATED : July 12, 2011
INVENTOR(S) : Pascal Drillet et al.

It is certified that error appears in the above-identified patent and that said Letters Patent is hereby corrected as shown below:

Column 2, line 34, "iron and with" should read --iron and oxidizing with--.
Column 2, line 64, "S≤3%" should read --Si≤3%--.
Column 3, line 39, "the strength increased" should read --the strength is increased--.

Signed and Sealed this
First Day of November, 2011

David J. Kappos

David J. Kappos
*Director of the United States Patent and Trademark Office*